US010630027B2

(12) United States Patent
Tsukamoto et al.

(10) Patent No.: US 10,630,027 B2
(45) Date of Patent: Apr. 21, 2020

(54) CONNECTOR WITH SELECTIVE PLACEMENT OF NOISE REDUCTION MEMBER

(71) Applicant: Yazaki Corporation, Tokyo (JP)

(72) Inventors: Masashi Tsukamoto, Makinohara (JP); Takashi Odajima, Makinohara (JP); Yasuyuki Saito, Makinohara (JP); Hiroaki Ito, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/114,781

(22) Filed: Aug. 28, 2018

(65) Prior Publication Data

US 2019/0109417 A1 Apr. 11, 2019

(30) Foreign Application Priority Data

Oct. 5, 2017 (JP) ..... 2017-195315

(51) Int. Cl.

| | |
|---|---|
| ***H01R 13/6588*** | (2011.01) |
| ***H01R 13/7193*** | (2011.01) |
| ***H01R 13/41*** | (2006.01) |
| ***H01R 13/424*** | (2006.01) |
| ***H01R 13/506*** | (2006.01) |

(52) U.S. Cl.

CPC ..... *H01R 13/6588* (2013.01); *H01R 13/41* (2013.01); *H01R 13/424* (2013.01); *H01R 13/506* (2013.01); *H01R 13/7193* (2013.01)

(58) Field of Classification Search

CPC ..... H01R 13/7193; H01R 13/7195; H01R 13/506; H01R 31/08

USPC ..... 439/620.05, 731, 189

See application file for complete search history.

(56) References Cited

U.S. PATENT DOCUMENTS

| | | | | |
|---|---|---|---|---|
| 4,804,332 | A * | 2/1989 | Pirc | H01R 13/7195 29/832 |
| 5,213,522 | A * | 5/1993 | Kojima | H01R 13/7195 333/185 |
| 5,224,878 | A * | 7/1993 | Lurie | H01R 13/7195 439/620.12 |
| 5,340,334 | A * | 8/1994 | Nguyen | H01R 13/7195 439/108 |
| 5,403,204 | A * | 4/1995 | Chishima | H01R 13/4223 439/189 |
| 7,841,911 | B2 * | 11/2010 | Aizawa | H01R 31/065 439/723 |
| 9,209,561 | B2 * | 12/2015 | Miyakawa | H01R 13/6273 |

(Continued)

FOREIGN PATENT DOCUMENTS

| | | |
|---|---|---|
| JP | 2008-192463 A | 8/2008 |
| JP | 2012-69270 A | 4/2012 |

*Primary Examiner* — Tulsidas C Patel
*Assistant Examiner* — Marcus E Harcum
(74) *Attorney, Agent, or Firm* — Sughrue Mion, PLLC

(57) ABSTRACT

A connector is equipped with a housing capable of being fitted in a mating housing of a mating connector, a plurality of terminals which are held by the housing and electrically connected to each other, and a noise reduction member which is held in the housing so as to reduce noise occurring in the terminals. The noise reduction member is disposed at at least one of the plurality of terminals, and is not disposed at at least one of the remaining terminals of the plurality of terminals. The noise reduction member is made of a material containing ferrite.

7 Claims, 7 Drawing Sheets

(56) References Cited

U.S. PATENT DOCUMENTS

| | | | | |
|---|---|---|---|---|
| 2009/0095501 | A1* | 4/2009 | Toyama | H01B 7/0045<br>174/113 R |
| 2013/0303023 | A1* | 11/2013 | Miwa | H01R 13/506<br>439/620.05 |
| 2013/0337696 | A1* | 12/2013 | Sakamoto | H01R 4/28<br>439/658 |
| 2015/0044895 | A1* | 2/2015 | Aizawa | H01R 13/6598<br>439/278 |

* cited by examiner

CONNECTOR WITH SELECTIVE PLACEMENT OF NOISE REDUCTION MEMBER

CROSS-REFERENCES TO RELATED APPLICATIONS

This application is a based on and claims priority from Japanese Patent Applications No. 2017-195315 filed on Oct. 5, 2017, the entire contest of which are incorporated herein by reference.

BACKGROUND OF THE INVENTION

Technical Field

The present invention relates to a connector having a plurality of terminals that are electrically connected to each other.

Background Art

A connector having a housing which holds a plurality of terminals electrically connected to each other is widely known. The connector of this type is also called as a joint connector. The joint connector is typically used being fitted in a mating connector connected to a trunk line and a branch line so as to branch the branch line from the trunk line constituting an electric circuit.

In a case that a joint connector is used to have branch lines branch off a trunk line, noise (ringing) is prone to occur due to reflection waves mainly in the branch lines which are larger in terminal resistance than the trunk line.

In order to suppress such noise, in one conventional joint connector, every terminal held by a housing is provided with a noise reduction member for reducing noise (for example, see Patent document 1). Since the noise reduction members are provided for all of the terminals, respectively, one type of joint connector, that is, a common connector, can be applied to a number of electrical circuits.

Patent document 1: JP-A-2012-69270

SUMMARY OF THE INVENTION

Where a joint connector is used to have branch lines branch off a trunk line, noise is not prone to occur in the trunk line which is smaller in terminal resistance than the branch lines. Among the branch lines, short ones are less prone to noise like the trunk line because they are small in terminal resistance. In other words, among the plurality of terminals of a joint connector there may exist terminals that are low in the necessity to be provided with a noise reduction member.

In the above conventional joint connector, the noise reduction members are provided for all of the terminals, respectively, though there exist terminals that are low in the necessity to be provided with a noise reduction member. This results in size increase and cost increase of the joint connector as a whole. It is desirable to minimize such size increase and cost increase of a joint connector.

The present invention has been made in view of the above circumstances, and an object of the invention is therefore to provide a connector capable of suppressing its size increase and cost increase.

In order to attain the above object, the invention provides connectors having features that are described below in the form of items (1) to (5):

(1) A connector comprising:

a housing capable of being fitted in a mating housing of a mating connector;

a plurality of terminals which are held in the housing and electrically connected to each other; and a noise reduction member which is held in the housing so as to reduce noise occurring in the terminals, wherein the noise reduction member is disposed at at least one of the plurality of terminals, and is not disposed at at least one of the remaining terminals of the plurality of terminals.

(2) The connector according to item (1), wherein:

the mating connector is connected to a trunk line and a branch line constituting an electric circuit, the plurality of terminals includes trunk-line connection terminals which are electrically connected to the trunk line when the housing is fitted in the mating housing, and branch-line connection terminals which are electrically connected to the branch line when the housing is fitted in the mating housing, the noise reduction member is not disposed at the trunk-line connection terminals, and the noise reduction member is disposed at at least one of the branch-line connection terminals or all of the branch-line connection terminals.

(3) The connector according to item (2), wherein:

all of the terminals in which the noise reduction member is disposed among the plurality of terminals are disposed adjacent to each other, and the noise reduction member is formed by one lump.

(4) The connector according to item (1), wherein the noise reduction member is made of a material containing ferrite.

(5) The connector according to item (2), wherein two terminals of the plurality of terminals are the trunk-line connection terminals, and the remaining terminals other than the two terminals are the branch-line connection terminals.

In the connector (joint connector) having the configuration of item (1), noise reduction member or members are disposed so as to correspond to only the part of the plurality of terminals. In other words, the noise reduction member or members can be provided only for terminals where noise is prone to occur among the plurality of terminals whereas no noise reduction member is provided for terminals where noise is relatively less prone to occur. As a result, size increase and cost increase of the connector as a whole can be suppressed unlike in the above-described conventional connector.

In the connector having the configuration of item (2), the noise reduction member or members are provided for part or all of the branch-line connection terminal where noise is prone to occur whereas no noise reduction member is provided for the connection-to-trunk-line terminal where noise is not prone to occur. As a result, where the connector is used to have branch lines branch off trunk lines, the noise reduction member or members can be provided properly only for terminals where noise is relatively prone to occur.

Where a plurality of connectors are connected together in series via trunk lines, the noise reduction members are not disposed at an unduly large number of locations in a route including the trunk lines and extending via the plurality of connectors. Thus, when a signal is transmitted from a trunk line at one end to a trunk line at the other end, a phenomenon is not prone to occur that an output signal waveform is distorted too much with respect to an input signal waveform due to disposition of noise reduction members at a large number of locations in the route including the trunk lines. This will be described later in detail.

According to the connector having the configuration of item (3), for example, work of attaching the noise reduction members can be made simpler than in a case that the noise reduction members are disposed individually so as to correspond the plurality of respective terminals.

According to the connector having the configuration of item (4), since the noise reduction member or members are made of a material containing ferrite which is very high in noise reducing ability, the noise reducing effect can be exercised stably and reliably.

The present invention can provide a connector capable of suppressing its size increase and cost increase.

The present invention has been described above concisely. The details of the invention will become more apparent when the modes for carrying out the invention (hereinafter referred to as an embodiment) described below are read through with reference to the accompanying drawings.

DESCRIPTION OF THE PREFERRED EMBODIMENT

A specific embodiment of the present invention will be hereinafter described with reference to the drawings.

Embodiment

A connector 1 according to the embodiment of the present invention will be hereinafter described with reference to the drawings. The connector 1, which is also called as a joint connector, has a plurality of terminals that are electrically connected to each other. The connector 1 is typically used being fitted with a mating connector that is connected to trunk lines and branch lines, to have the branch lines branch off the trunk lines that constitute an electric circuit (see FIG. 2 etc.). Each of the trunk lines and the branch lines which constitute the electric circuit is a two-wire line (twisted line) for transmitting a signal in "two-wire differential voltage form."

Figure 1:
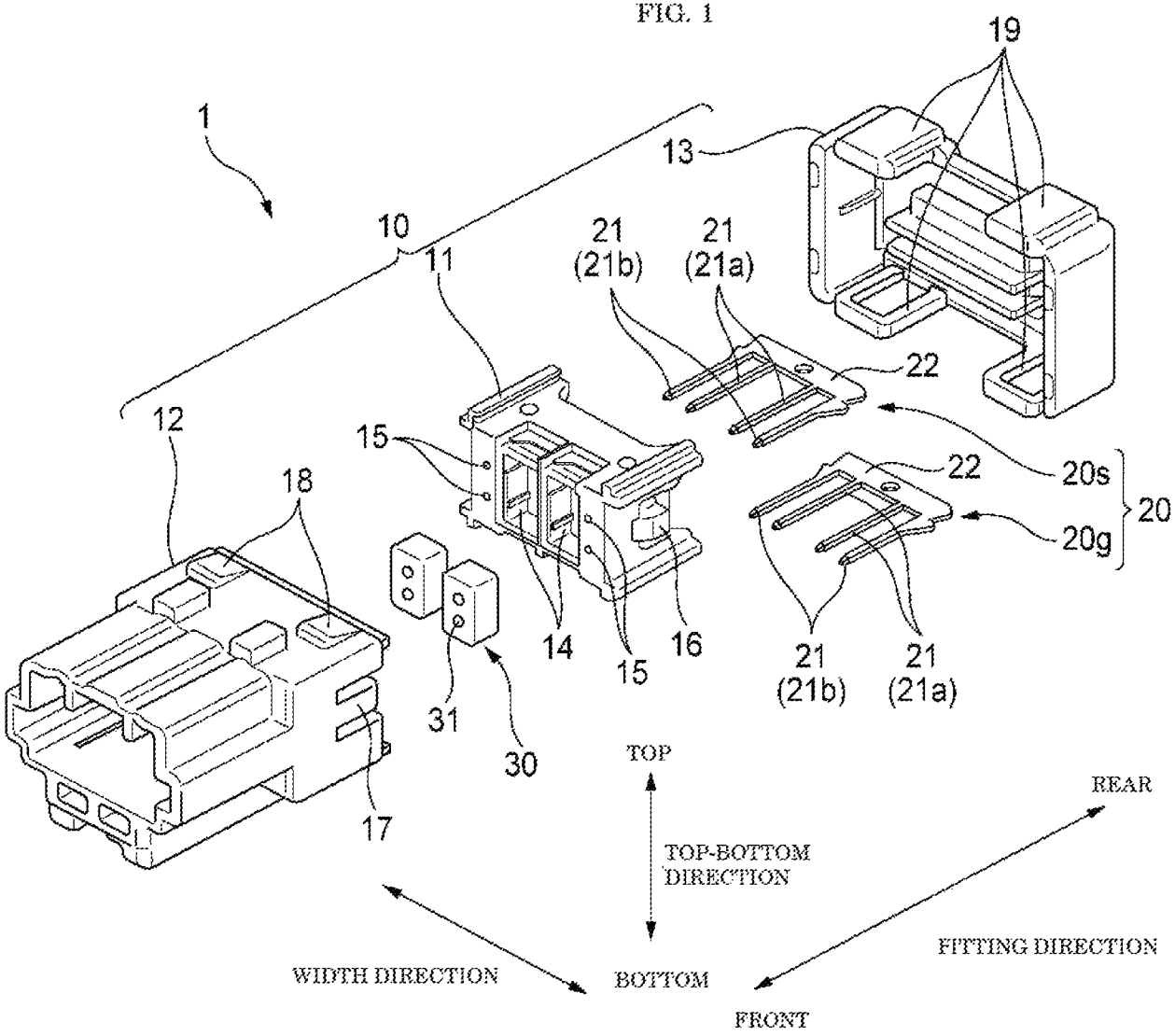
FIG. 1 is an exploded perspective view of a connector according to an embodiment of the present invention.

As shown in FIG. 1, the connector 1 according to the embodiment of the invention is equipped with a housing 10, busbars 20 which are held by the housing 10, and noise reduction members 30 which are held by the housing 10. In the following description, for the sake of convenience, "the fitting direction", "the width direction", "the top-bottom direction", "the front", "the rear", "the top", and "the bottom" are defined as shown in FIG. 1. The fitting direction, the width direction, the top-bottom direction are perpendicular to each other.

The housing 10 made of a resin has an inner housing 11, an outer housing 12 which is attached to the inner housing 11 from the front side, and a cover 13 which is attached to the inner housing 11 from the rear side.

The inner housing 11 is approximately shaped like a cuboid, and noise reduction member holding rooms 14 for holding the respective noise reduction members 30 are formed adjacent to its front surface. In the embodiment, two noise reduction member holding rooms 14 are formed so as to be arranged in the width direction. Each noise reduction member holding room 14 is a cuboid-shaped recess that conforms to the shape of each noise reduction member 30 and has a front opening. The rear wall of each noise reduction member holding room 14 is formed with two (upper and lower) through-holes (not shown) which extend in the front-rear direction and through which terminals 21 (21*a*) of the busbars 20 are inserted.

Through-holes 15 through which terminals 21 (21*b*) of the busbars 20 are inserted are formed through two side walls, located outside the two noise reduction member holding rooms 14 in the width direction, of the inner housing 11 at two positions in the top-bottom direction so as to extend in the front-rear direction (four through-holes 15 are formed in total). The two outer side surfaces of the inner housing 11 are formed with respective lock projections 16 which project outward in the width direction and on which the outer housing 12 is locked.

The noise reduction members 30 are members that are disposed so as to correspond to terminals 21 of the busbars 20 to reduce noise (e.g., noise due to reflection waves) occurring in the terminals 21 (21*a*) of the busbars 20. Each noise reduction member 30 is a block that is approximately shaped like a cuboid so as to conform to the shape of each noise reduction member holding room 14, and, in the embodiment, is made of ferrite. Although it is preferable that each noise reduction member 30 be made of a material containing ferrite, it may be made of any material as long as it can reduce noise occurring in the associated terminals 21.

Two through-holes 31 through which terminals 21 are inserted penetrate through each noise reduction member 30 at two positions in the top-bottom direction. The noise reduction members 30 are inserted into the two respective noise reduction member holding room 14 individually from the front side and held in them. In a state that each noise reduction member 30 is held in the associated noise reduction member holding room 14 the upper and lower through-holes 31 share the same axes as the upper and lower through-holes of the rear wall of the associated noise reduction member holding room 14, respectively.

The outer housing 12 is approximately shaped like a rectangular pipe and attached to the inner housing 11 from the front side so that the inner housing 11 is inserted into it. An attachment-completed state of the outer housing 12 is maintained (i.e., the inner housing 11 is prevented from coming off the outer housing 12) because a pair of lock nails 17 which are formed in two respective side walls (arranged in the width direction) of the outer housing 12 are engaged with the pair of lock projections 16 of the inner housing 11.

The metal busbars 20 has a signal wire busbar 20*s* and a grounding wire busbar 20*g* which are the same in shape. In the following description, each of the busbars 20*s* and 20*g* will be referred to as a "busbar 20" unless they need to be discriminated from each other.

Each busbar 20 is formed by a plurality of (in the embodiment, four) terminals 21 (male terminals) which are arranged parallel with each other and a link portion 22 which links the rear ends of the plurality of terminals 21. In the following description, for the sake of convenience, the two terminals located inside in the width direction may be referred to as "terminals 21*a*" and the two terminals located outside in the width direction may be referred to as "terminals 21*b*."

The busbar 20*s* is inserted into the inner housing 11 from the rear side so that the terminals 21*a* are inserted through the upper through-holes of the rear walls of the noise reduction member holding rooms 14 and the upper through-holes 31 of the noise reduction members 30 and the terminals 21*b* are inserted through the upper through-holes 15. The busbar 20*g* is inserted into the inner housing 11 from the rear side so that the terminals 21*a* are inserted through the lower through-holes of the rear walls of the noise reduction member holding rooms 14 and the lower through-holes 31 of the noise reduction members 30 and the terminals 21*b* are inserted through the lower through-holes 15.

The busbars 20*s* and 20*g* thus inserted are fixed to the inner housing 11 so as to be located at two (upper and lower) levels and to be parallel with each other because the link portions 22 are press-fitted in the inner housing 11 at prescribed locations. In a state that fixing of the busbars 20*s* and 20*g* is completed, the two terminals 21*a* arranged on the inside in the width direction are located at two (upper and lower) levels and project forward beyond the front surfaces of the noise reduction members 30. The two terminals 21*b* arranged on the outside in the width direction are located at two (upper and lower) levels in the two side walls of the inner housing 11 and project forward from the openings of the through-holes 15.

In other words, an upper terminal 21 that is one of the four terminals 21 of the signal wire busbar 20*s* and a lower terminal 21 that is a corresponding one of the four terminals 21 of the grounding wire busbar 20*g* are arranged at the two levels in the top-bottom direction and project beyond the front surface of the inner housing 11. The portions, projecting beyond the front surface of the inner housing 11, of the plurality of terminals 21 (the eight terminals 21 in total arranged at the two (upper and lower) levels in the top-bottom direction) are located in the internal space of the outer housing 12 and thus protected from outside by the outer housing 12.

Since as described above the noise reduction members 30 are held in the two respective noise reduction member holding rooms 14, each noise reduction member 30 is disposed so as to bridge two (upper and lower) terminals 21*a* for a two-wire line (twisted line) that are located inside in the width direction among the eight terminals 21 of the busbars 21*s* and 21*g*. As a result, noise occurring between these two terminals 21*a* is reduced.

In the embodiment, the noise reduction members 30 are held in the respective noise reduction member holding rooms 14 of the inner housing 11 in which the two inside terminals 21*a* of the four terminals 21 of each busbar 20 are located.

On the other hand, no noise reduction member holding room 14 exists for the two outside terminals 21*b* of the four terminals 21 of each busbar 20. Thus, no noise reduction member 30 is provided for these two outside terminals 21*b*.

The cover 13 is shaped like a rectangular box that is open on the front side, and is attached to the inner housing 11 from the rear side so that the outer housing 12 that is attached to the inner housing 11 is inserted into the cover 13. In a state that attachment of the cover 13 is completed, two (top and bottom) pairs of lock nails 19 which are located at the four corners of the cover 13 are engaged with two (top and bottom) pairs of lock projections 18 which are formed on the top and bottom surfaces of the outer housing 12. Thus, the attachment-completed state of the cover 13 is maintained, that is, the cover 13 is prevented from coming off the inner housing 11. Disposed in this manner, the cover 13 prevents coming-off of the busbars 20 and intrusion of dust into the inner housing 11.

As described above, in the connector 1 according to the embodiment, the noise reduction members 30 are provided for the two inside terminals 21*a* of the four terminals 21 of each busbar 20 and no noise reduction member 30 is provided for the two outside terminals 21*b* of the four terminals 21 of each busbar 20. In other words, if the two terminals 21*a* are selected as terminals where noise is relatively prone to occur and the two terminals 21*b* are selected as terminals where noise is not prone to occur among the four terminals 21 of each busbar 20, the noise reduction members 30 can be provided for the two terminals 21*a* where noise is relatively prone to occur.

As a result, size increase and cost increase of the connector 1 as a whole can be suppressed unlike in the above-described conventional connector in which noise reduction member holding rooms and noise reduction members are provided for all of the terminals.

Figure 2:
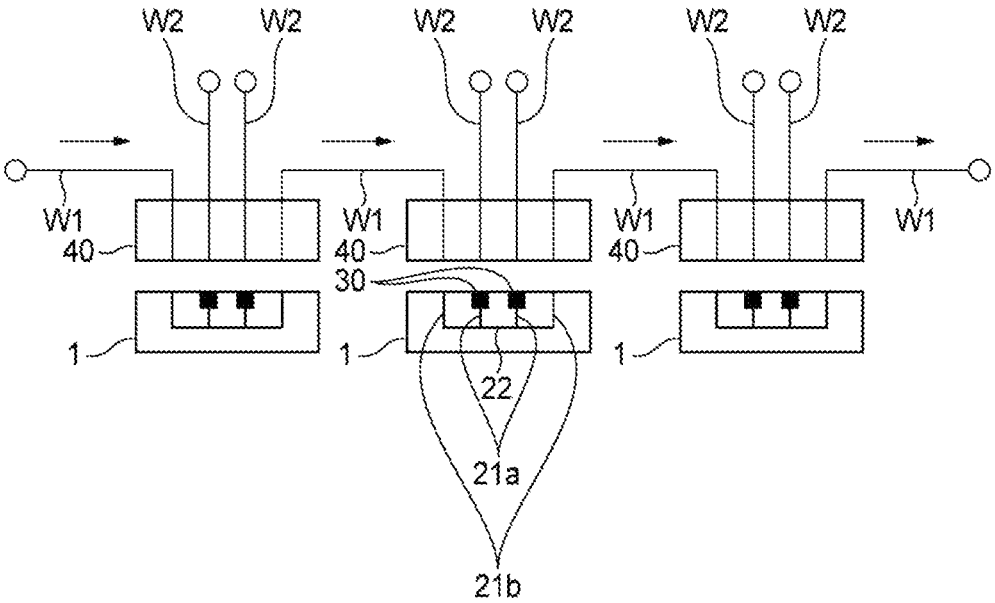
FIG. 2 is a schematic diagram showing a configuration in which connectors shown in FIG. 1 are connected together in series via trunk lines.

Next, a description will be made of a case that the connectors 1 are used to have branch lines branch off trunk lines that constitute an electric circuit. In this case, as shown in FIG. 2, connectors 1 are used in such a manner as to be fitted with respective mating connectors 40 each of which is connected to trunk lines W1 and branch lines W2 of the electric circuit. In the following description, an integrated connector formed by fitting a connector 1 with a mating connector 40 may be referred to as a "branching connector."

In FIG. 2, hollow circles represent electric devices (this also applies to FIGS. 3, 5, 8, 9, and 10). Although in FIG. 2 each of the trunk lines W1 and the branch lines W2 is drawn by a single solid line, as described above, in actuality it is a two-wire line (twisted line) (this also applies to FIGS. 3, 5, 8, 9, and 10).

Four terminals (eight terminals (female terminals) in total if terminals connected to the respective wires of a two-wire line (twisted line) are discriminated from each other) that are connected to the two trunk lines W1 and two branch lines W2, respectively, are housed in a housing of each mating connector 40.

The housing of each mating connector 40 is fitted into the outer housing 12 of the corresponding connector 1. As a result, the four terminals (female terminals) housed in the housing of each mating connector 40 are electrically connected to the four respective terminals 21 of the corresponding connector 1, whereby for each connector 1 (i.e., single branching connector) the trunk lines W1 are electrically connected to the branch lines W2 and an electric circuit is formed in which the two branch lines W2 branch off the trunk lines W1.

In the example shown in FIG. 2, among the four terminals 21 of the busbar 20, the two inside terminals 21*a* are connected to the branch lines W2 via the mating connector 40 and the two outside terminals 21*b* are connected to the trunk lines W1 via the mating connector 40. Thus, in the following description, the terminals 21*a* may be referred to as "branch-line connection terminals 21*a*" and the terminals 21*b* may be referred to as "trunk-line connection terminals 21*b*."

In the example shown in FIG. 2, the noise reduction members 30 are provided for the two branch-line connection terminals 21*a* among the four terminals 21 of the busbar 20 and no noise reduction member 30 is provided for the two trunk-line connection terminals 21*b*. Furthermore, three branching connectors (each consisting of a connector 1 and a mating connector 40) are connected together in series via the trunk lines W1.

In the following, as a preparation for description of workings and advantages of the configuration shown in FIG. 2, first, Comparative Example 1 shown in FIG. 3 will be described in which no noise reduction member 30 is provided for any of the four terminals 21 of the busbar 20 and three branching connectors are connected together in series via trunk lines W1.

In general, in an electric circuit in which branch lines W2 branch off trunk lines W1 as in Comparative Example 1, noise (ringing) due to reflection waves is prone to occur mainly in the branch lines W2 which are larger in terminal resistance than the trunk lines W1. In Comparative Example 1, when reflection waves occur mainly in the branch lines W2, noise cannot be reduced because no noise reduction member 30 is provided for any of the four terminals 21 of the busbar 20.

Figure 3:
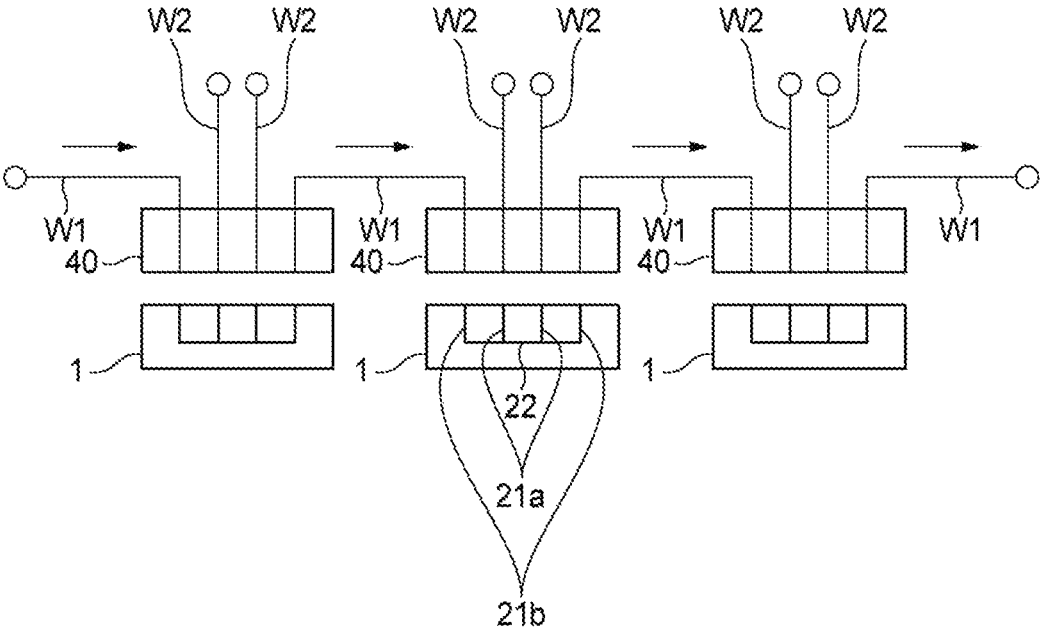
FIG. 3 is a schematic diagram that corresponds to FIG. 2 and shows a configuration of Comparative Example 1 in which no noise reduction member is provided for any terminal.

Thus, when as indicated by arrows in FIG. 3 a signal (e.g., an input signal having a steep rectangular waveform (represented by a broken line in FIG. 4) is transmitted from the input-side (left) trunk line W1 to the output-wide (right) trunk line W1, relatively large noise is prone to occur in an output signal waveform (represented by a solid line in FIG. 4) at the output-side trunk line W1 immediately after every time point when the input signal waveform varies.

Figure 5:
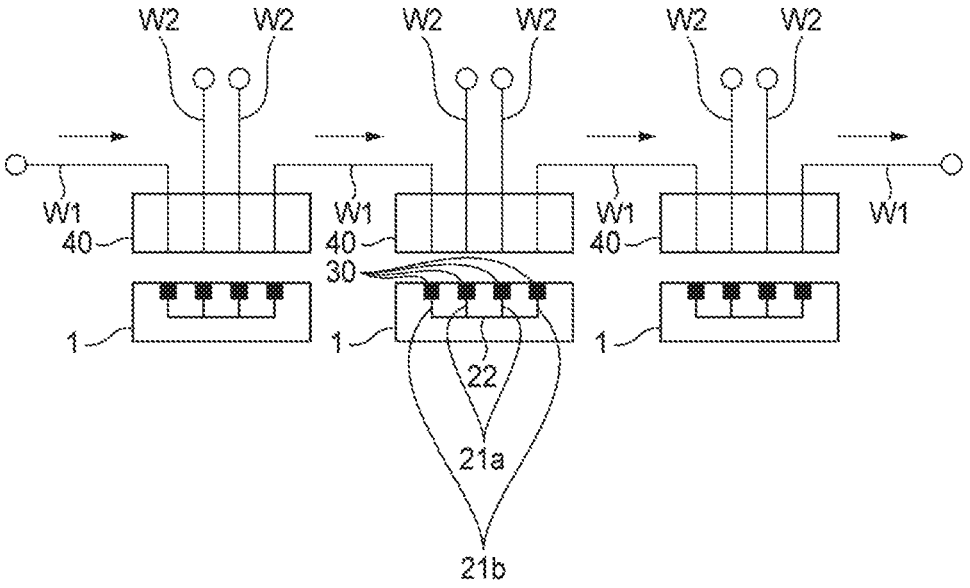
FIG. 5 is a schematic diagram that corresponds to FIG. 2 and shows a configuration of Comparative Example 2 in which a noise reduction member is provided for every terminal.

Next, Comparative Example 2 shown in FIG. 5 will be described in which a noise reduction member 30 is provided for all of the four terminals 21 of the busbar 20 and three branching connectors are connected together in series via trunk lines W1. In Comparative Example 2, a noise reduction member 30 is provided for not only the two connection-to-branch-line terminal 21*a* but also the two connection-to-trunk-line terminal 21*b*.

Figure 4:
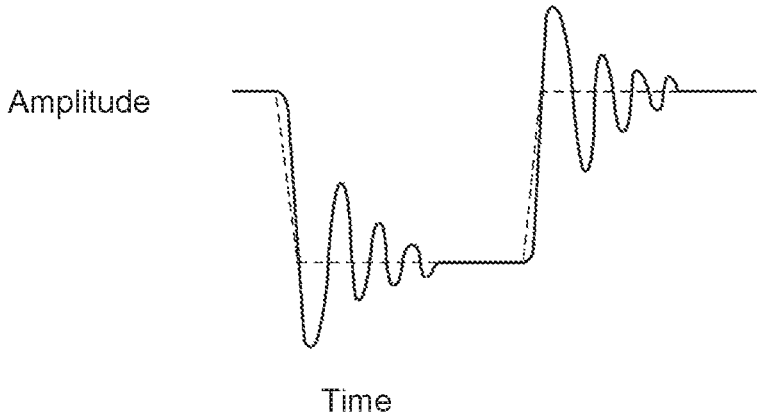
FIG. 4 shows example input and output signal waveforms that occur in trunk lines in Comparative Example 1 shown in FIG. 3.
Figure 6:
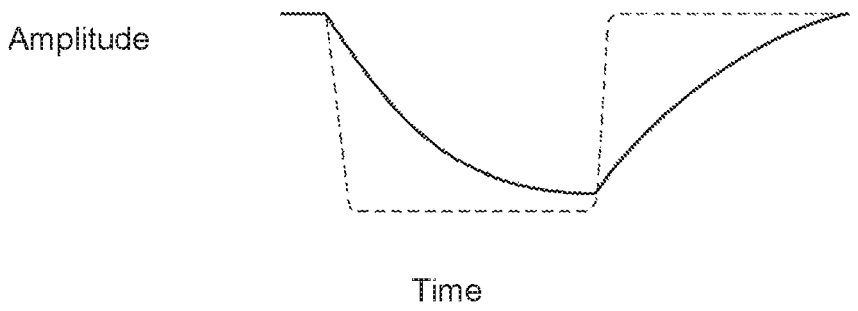
FIG. 6 shows example input and output signal waveforms that occur in trunk lines in Comparative Example 2 shown in FIG. 5.

In Comparative Example 2, when a signal having the same rectangular input signal waveform as shown in FIG. 4 is given from the input-side trunk line W1, as shown in FIG. 6, whereas noise (ringing) is reduced sufficiently in an output signal waveform (represented by a solid line) at the output-side trunk line W1, the output signal waveform is unduly distorted (delayed) with respect to (from) the input signal waveform.

This phenomenon is thought to be due to an excessive degree of effectuation of the noise reducing effect (similar to what is called lowpass filtering) of the noise reduction members 30 because the noise reduction members 30 are disposed at many locations (more specifically, two locations per connector 1 and hence six locations in total) in the route from the input-side (left) trunk line W1 to the output-side (right) trunk line W1.

Figure 7:
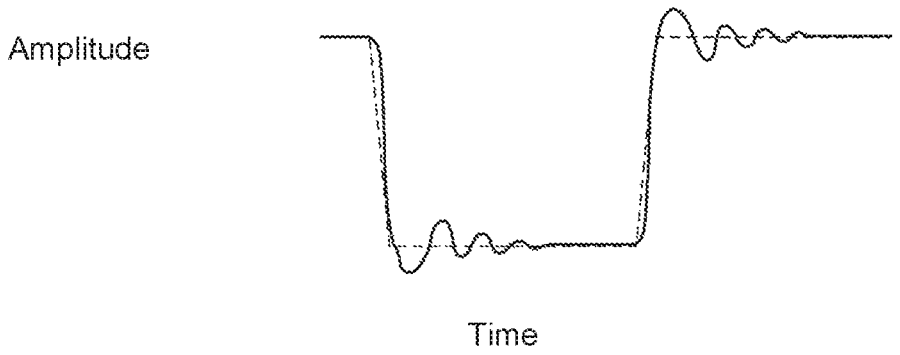
FIG. 7 shows example input and output signal waveforms that occur in trunk lines in the configuration shown in FIG. 2.

In the configuration shown in FIG. 2, in contrast to Comparative Examples 1 and 2, when a signal having the same rectangular input signal waveform as shown in FIG. 4 is given from the input-side trunk line W1, as shown in FIG. 7 relatively large noise as shown in FIG. 4 does not occur in an output signal waveform (represented by a solid line) at the output-side trunk line W1 immediately after each time point when the input signal waveform varies. In addition, the output signal waveform is not distorted (delayed) with respect to (from) the input signal waveform unlike in Comparative Example 2 (see FIG. 6).

This is considered due to a proper degree of effectuation of the noise reducing effect of the noise reduction members 30 because no noise reduction member 30 is provided for the two trunk-line connection terminals 21*b* where noise is not prone to occur whereas reduction members 30 are provided for the two respective branch-line connection terminals 21*a* where noise is prone to occur.

Figure 8:
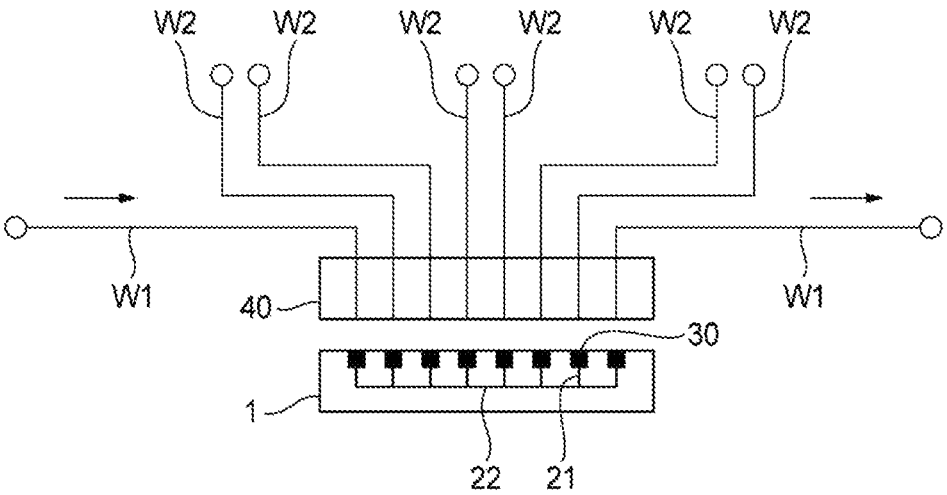
FIG. 8 is a schematic diagram that corresponds to FIG. 2 and shows a configuration of Comparative Example 3 in which a noise reduction member is provided for every terminal and the number of branch lines that branch off trunk lines is large.

Next, further workings and advantages of the configuration shown in FIG. 2 will be described. First, as a preparation, a description will be made of a case that as shown in Comparative Example 3 shown in FIG. 8 too many (in Comparative Example 3, six) branch lines W2 branch off trunk lines W1 in a single connector 1 (i.e., single branching connector).

Where too many branch lines W2 branch off a single connector as in this case, reflection waves coming from the branch lines W2 concentrate in the single branching connector. Thus, even if as shown in FIG. 8 a noise reduction member 30 is provided for every terminal 21 of the single connector 1, relatively large noise (ringing) is prone to occur as shown in FIG. 4.

Figure 9:
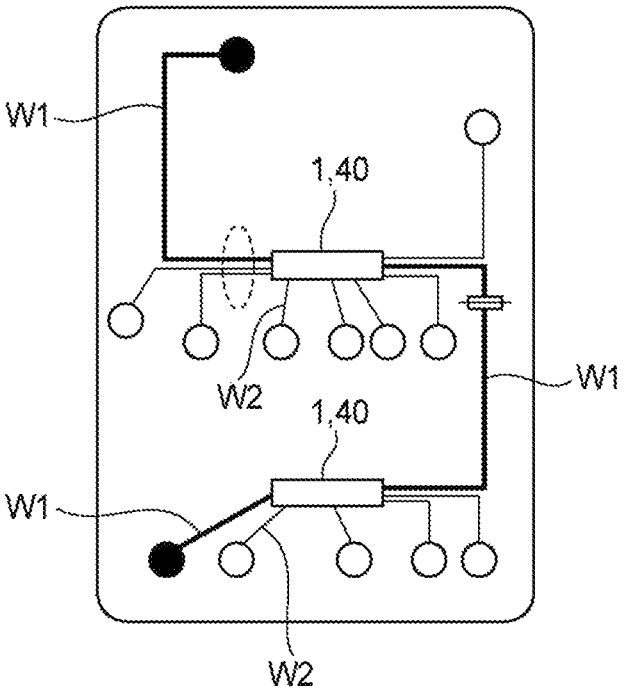
FIG. 9 is a schematic diagram showing an example of routing of trunk lines and branch lines in a case that the configuration of Comparative Example 3 shown in FIG. 8 is applied to a vehicle.

Furthermore, where as shown in FIG. 9 trunk lines W1 and branch lines W2 are routed in a vehicle using branching connectors in each of which too many branch lines W2 branch off trunk lines W1, there occur many locations where branch lines W2 run parallel with a trunk line W1 (e.g., indicated by a broken-line ellipse in FIG. 9). At the locations where branch lines W2 run parallel with a trunk line W1, a wire bundle (wire harness) is made thick. That is, there occur many locations where the wire bundle (wire harness) is thick.

In addition, since a large number of electric devices exist at locations that are relatively far from a branching connector, the total length of the branch lines W2 that connect the branching connectors to electric devices is long. That is, the total path length and the total weight of electric wires (wire harness) become long or large.

Figure 10:
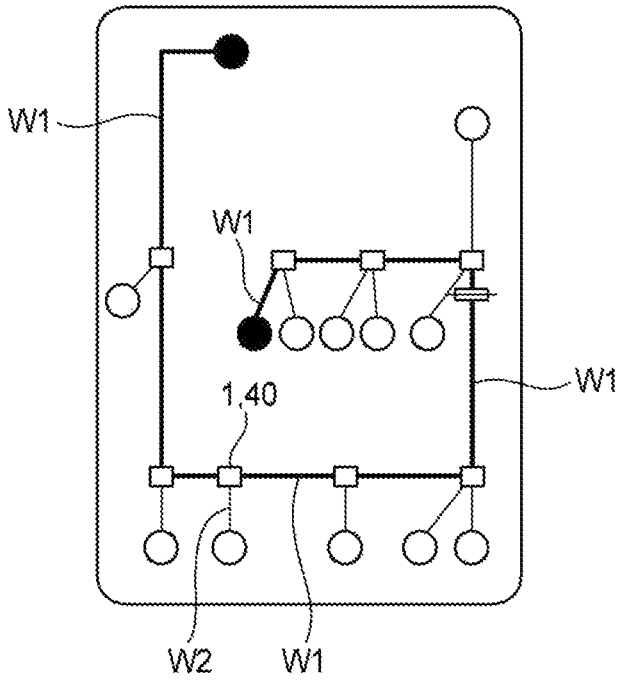
FIG. 10 is a schematic diagram showing an example of routing of trunk lines and branch lines in a case that the configuration shown in FIG. 2 is applied to a vehicle.

In contrast, in the configuration of FIG. 2, the number of branch lines W2 that branch off in a single branching connector is small (more specifically, two). Therefore, as shown in FIG. 10, in a vehicle, many branching connectors can be disposed according to a manner of arrangement of many electric devices. As a result, the number of locations where branch lines W2 run parallel with a trunk line W1 is small (in the example shown in FIG. 10, there are no such locations) and hence the number of locations where the wire bundle (wire harness) is thick is small.

In addition, the number of electric devices that are relatively far from a branching connector is small and hence the total length of branch lines W2 that connect branching connectors to electric devices is short. That is, the total path length and the total weight of electric wires (wire harness) are short or small.

Furthermore, since the number of branch lines W2 that branch off in a single branching connector is small, reflection waves coming from the respective branch lines W2 are not prone to concentrate in the single branching connector. As a result, noise can be reduced sufficiently and properly in the above-described manner even if no noise reduction member 30 is provided for each connection-to-trunk-line terminal 21*b*.

Another Embodiment

The invention is not limited the above embodiment, and various modifications, improvements, etc. can be made as appropriate without departing from the scope of the invention. And the material, shape, dimensions, number (where a plurality of ones are provided), location, etc. of each constituent element of the embodiment are optional and no limitations are imposed on them as long as the invention can be implemented.

Figure 11:
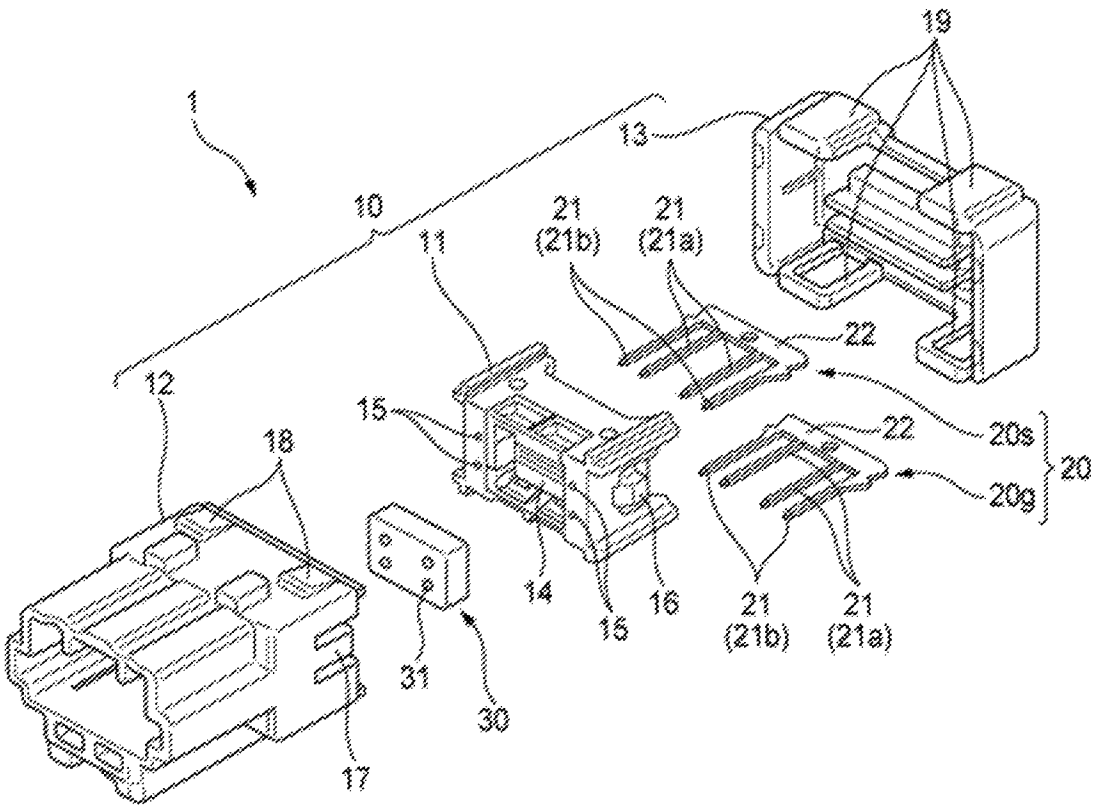
FIG. 11 is an exploded perspective view corresponding to FIG. 1 and shows a connector according to a modification of the embodiment of the present invention.

For example, in the embodiment, as shown in FIG. 1, the two noise reduction members 30 are housed and held in the two respective noise reduction member holding rooms 14 individually and thereby provided for the two terminals 21*a* adjacent to each other. An alternative configuration shown in FIG. 11 is possible in which a single noise reduction member 30 (single block) is housed and held in a single noise reduction member holding room 14 and thereby provided for the two terminals 21*a* adjacent to each other. In this case, since the number of noise reduction members 30 is made smaller than in the configuration shown in FIG. 1, for example, work of attaching the noise reduction member(s) 30 can be simplified.

In the configuration shown in FIG. 2, no noise reduction member 30 is provided for any of the trunk-line connection terminals 21*b* included in the three connectors 1 which are connected together in series. Alternatively, a noise reduction member 30 may be provided for part of the trunk-line connection terminals 21*b* included in the plurality of connectors 1 that are connected together in series.

Furthermore, in the configuration shown in FIG. 2, a noise reduction member 30 is provided for every branch-line connection terminal 21*a* of the connectors 1. An alternative configuration is possible in which no noise reduction member 30 is provided for part of the branch-line connection terminals 21*a* of connectors 1.

Still further, in the configuration shown in FIG. 1, the terminals 21 of the connector 1 are male terminals and the terminals of the mating connector are female terminals. An alternative a configuration is possible in which the terminals 21 of the connector 1 are female terminals and the terminals of the mating connector are male terminals.

Features of the connector 1 according to the embodiment of the present invention will be summarized below concisely in the form of items (1) to (5):

(1) A connector (1) comprising:

a housing (10) capable of being fitted in a mating housing of a mating connector (40);

a plurality of terminals (21) which are held by the housing (10) and electrically connected to each other; and a noise reduction member (30) which is held in the housing (10) so as to reduce noise occurring in the terminals (21), wherein the noise reduction member (30) is disposed at least one of the plurality of terminals (21*a*), and is not disposed at at least one of the remaining terminals of the plurality of terminals (21*b*).

(2) The connector (1) according to item (1), wherein:

the mating connector (40) is connected to trunk a line (W1) and a branch line (W2) constituting an electric circuit;

the plurality of terminals (21) includes trunk-line connection terminals (21*b*) which are electrically connected to the trunk line (W1) when the housing (10) is fitted in the mating housing, and branch-line connection terminals (21*a*) which are electrically connected to the branch line (W2) when the housing (10) is fitted in the mating housing, the noise reduction member (30) is not disposed at the trunk-line connection terminals (21*b*), and the noise reduction member (30) is disposed at at least one of the branch-line connection terminals (21*a*) or all of the branch-line connection terminals (21*a*).

(3) The connector (1) according to item (2), wherein all of the plurality of terminals (21) in which the noise reduction member is disposed among the plurality of terminals are disposed adjacent to each other; and the noise reduction member (30) is formed by one lump.

(4) The connector (1) according to any one of items (1) to (3), wherein the noise reduction member is made of a material containing ferrite.

(5) The connector (1) according to claim 2, wherein two terminals of the plurality of terminals are the trunk-line connection terminals (21*b*), and the remaining terminals other than the two terminals are the branch-line connection terminals (21*a*).

What is claimed is:

1. A connector comprising:

a housing capable of being fitted in a mating housing of a mating connector;

a busbar including a plurality of terminals which are held in the housing and electrically connected to each other; and a noise reduction member which is held in the housing so as to reduce noise occurring in the terminals, wherein the noise reduction member is disposed on at least one of the plurality of terminals of the busbar, and is not disposed on at least one of the remaining terminals of the plurality of terminals of the busbar, wherein the mating connector is connected to a trunk line and a branch line constituting an electric circuit, wherein the plurality of terminals of the busbar includes trunk-line connection terminals which are electrically connected to the trunk line when the housing is fitted in the mating housing, and branch-line connection terminals which are electrically connected to the branch line when the housing is fitted in the mating housing, wherein the noise reduction member is not disposed on the trunk-line connection terminals, and wherein the noise reduction member is disposed on at least one of the branch-line connection terminals or all of the branch-line connection terminals.

2. The connector according to claim 1, wherein:

all of the terminals on which the noise reduction member is disposed among the plurality of terminals of the busbar are disposed adjacent to each other, and the noise reduction member is formed by one lump.

3. The connector according to claim 1, wherein:

the noise reduction member is made of a material containing ferrite.

4. The connector according to claim 1, wherein:

two terminals of the plurality of terminals of the busbar are the trunk-line connection terminals, and the remaining terminals other than the two terminals are the branch-line connection terminals.

5. The connector according to claim 1, further comprising:

another busbar including a plurality of terminals, and wherein the noise reduction member is disposed on the at least one of the plurality of terminals of the busbar, and is disposed on at least one of the plurality of terminals of the other busbar.

6. The connector according to claim 1, further comprising:

another busbar including another plurality of terminals; and another noise reduction member, wherein the noise reduction member is disposed on the at least one of the plurality of terminals of the busbar, and is disposed on at least one of the plurality of terminals of the other busbar, and wherein the other noise reduction member is disposed on at least one of the plurality of terminals of the busbar, and is disposed on at least one of the plurality of terminals of the other busbar.

7. The connector according to claim 1, wherein the noise reduction member comprises a plurality of through holes, and wherein the at least one of the plurality of terminals, on which the noise reduction member is disposed, of the busbar is inserted through one of the plurality of through holes.

* * * * *